US010767613B2

(12) United States Patent
Chinnici et al.

(10) Patent No.: US 10,767,613 B2
(45) Date of Patent: Sep. 8, 2020

(54) FUEL INJECTOR WITH LOCATING PINS, INTERNAL COMBUSTION ENGINE USING THE SAME, AND METHOD

(71) Applicant: DELPHI TECHNOLOGIES IP LIMITED, St. Michael (BB)

(72) Inventors: David A. Chinnici, Rochester, NY (US); Charles W. Braun, Canandaigua, NY (US); Gary J. De Angelis, Spencerport, NY (US); Norbert Raimann, Tawern (DE)

(73) Assignee: DELPHIA TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/196,917

(22) Filed: Nov. 20, 2018

(65) Prior Publication Data

US 2020/0158065 A1 May 21, 2020

(51) Int. Cl.
*F02M 61/14* (2006.01)
*F02M 61/18* (2006.01)

(52) U.S. Cl.
CPC ..... *F02M 61/14* (2013.01); *F02M 61/18* (2013.01); *F02M 2200/852* (2013.01); *F02M 2200/858* (2013.01); *F02M 2200/9015* (2013.01)

(58) Field of Classification Search
CPC .... F02M 61/14; F02M 61/18; F02M 61/1806; F02M 2200/852; F02M 2200/858; F02M 2200/9015; F02M 51/005; F02M 51/061; F02M 55/005; F02M 57/06; F02M 69/045; F02B 23/101; F02B 2075/0125
See application file for complete search history.

(56) References Cited

U.S. PATENT DOCUMENTS

| | | | | |
|---|---|---|---|---|
| 3,346,188 | A | 10/1967 | Nusbaum | |
| 5,263,881 | A | 11/1993 | Henrici et al. | |
| 6,840,227 | B2 * | 1/2005 | Reiter | F02M 61/14 123/470 |
| 7,886,717 | B2 * | 2/2011 | Rettig | F02M 61/14 123/470 |
| 8,047,183 | B2 * | 11/2011 | Aronhalt | F02M 61/14 123/470 |
| 10,415,525 | B2 * | 9/2019 | Del Rossa | B25B 27/0035 |
| 2004/0060544 | A1 * | 4/2004 | Reiter | F02M 61/14 123/470 |
| 2014/0304944 | A1 | 10/2014 | Carr et al. | |
| 2015/0075496 | A1 | 3/2015 | Pasquali et al. | |
| 2019/0316601 | A1 | 10/2019 | Shimamoto | |

FOREIGN PATENT DOCUMENTS

EP 2587047 A1 5/2013

* cited by examiner

*Primary Examiner* — George C Jin
(74) *Attorney, Agent, or Firm* — Joshua M. Haines

(57) ABSTRACT

A fuel injector includes a nozzle body configured to be inserted into a fuel injector receiving bore of the internal combustion engine along a nozzle body axis; a valve housing held in fixed relationship to the nozzle body; and a first locating pin and a second locating pin each extending from the valve housing. The first locating pin extends from a first locating pin fixed end which is fixed to the valve housing to a first locating pin free end. The second locating pin extends from a second locating pin fixed end which is fixed to the valve housing to a second locating pin free end. The first locating pin and the second locating pin elastically deform when inserted into the bore, thereby preventing rotational movement of the fuel injector about the nozzle body axis.

11 Claims, 8 Drawing Sheets

FUEL INJECTOR WITH LOCATING PINS, INTERNAL COMBUSTION ENGINE USING THE SAME, AND METHOD

TECHNICAL FIELD OF INVENTION

The present invention relates to a fuel injector for injecting fuel into a combustion chamber of an internal combustion engine, and more particularly to such a fuel injector with locating pins which orient the fuel injector relative to the combustion chamber and prevent rotation of the fuel injector.

BACKGROUND OF INVENTION

Fuel systems in modern internal combustion engines commonly inject fuel directly into a combustion chamber of the internal combustion engine. The fuel injector includes a nozzle body which is inserted into a fuel injector receiving bore of the internal combustion engine along a nozzle body axis. In order to achieve optimal combustion of the fuel provided by the fuel injector, thereby maximizing fuel efficiency and minimizing harmful exhaust emissions, it is known to orient the fuel injector relative to the combustion chamber in such a way that is most conducive of achieving optimal combustion. One known way to orient the fuel injector is illustrated in U.S. Pat. No. 7,886,717 to Rettig et al. where the fuel injector is provided with a fixation device which is received within a recess of the internal combustion engine which limits the extent to which the nozzle body is able to rotate within the fuel injector receiving bore. The fixation device of Rettig et al. is a feature which is formed in a plastic injection molding process with a valve housing of the fuel injector. In arrangements such as Rettig et al., the fixation device is designed to provide a clearance fit with the recess in order to accommodate for manufacturing variations when forming the fixation device. This clearance fit allows for some rotation of the fuel injector about the nozzle body axis, thereby resulting in variations in how the spray from the fuel injector is introduced into the combustion chamber. As a result, the spray from the fuel injector may not be optimally placed in the combustion chamber which may lead to reduced fuel economy and increased harmful exhaust emissions.

What is needed is a fuel injector which minimizes or eliminates one or more of the shortcomings as set forth above.

SUMMARY OF THE INVENTION

Briefly described, a fuel injector is provided by the present invention for injecting fuel into a combustion chamber of an internal combustion engine. The fuel injector includes a nozzle body configured to be inserted into a fuel injector receiving bore of the internal combustion engine along a nozzle body axis; a valve housing held in fixed relationship to the nozzle body; and a first locating pin and a second locating pin each extending from the valve housing, the first locating pin extending from a first locating pin fixed end which is fixed to the valve housing to a first locating pin free end and the second locating pin extending from a second locating pin fixed end which is fixed to the valve housing to a second locating pin free end, the first locating pin and the second locating pin collectively being configured to be inserted into a locating bore which elastically deforms the first locating pin and the second locating pin, thereby preventing rotational movement of the fuel injector about the nozzle body axis. An internal combustion engine including the fuel injector is also provided by the present invention. A method of assembling the fuel injector to the internal combustion engine is also provided by the present invention. The method includes inserting the nozzle body into the fuel injector receiving bore; inserting the first locating pin and the second locating pin into the locating bore; and elastically deforming the first locating pin and the second locating pin while the first locating pin and the second locating pin are being inserted into the locating bore such that the first locating pin and the second locating pin radially orient the nozzle body in the fuel injector receiving bore and thereby preventing rotation movement of the fuel injector about the nozzle body axis.

The fuel injector, internal combustion engine, and method of assembling the fuel injector to the internal combustion engine included herein provide for positive orientation, by forcing the locating pins collectively to be centered in the locating bore, of the fuel injector relative to the combustion chamber of the internal combustion engine which is necessary to achieve desired combustion of the fuel, thereby maximizing fuel efficiency, minimizing harmful exhaust emissions, and minimizing variation in fuel injector to combustion chamber placement.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
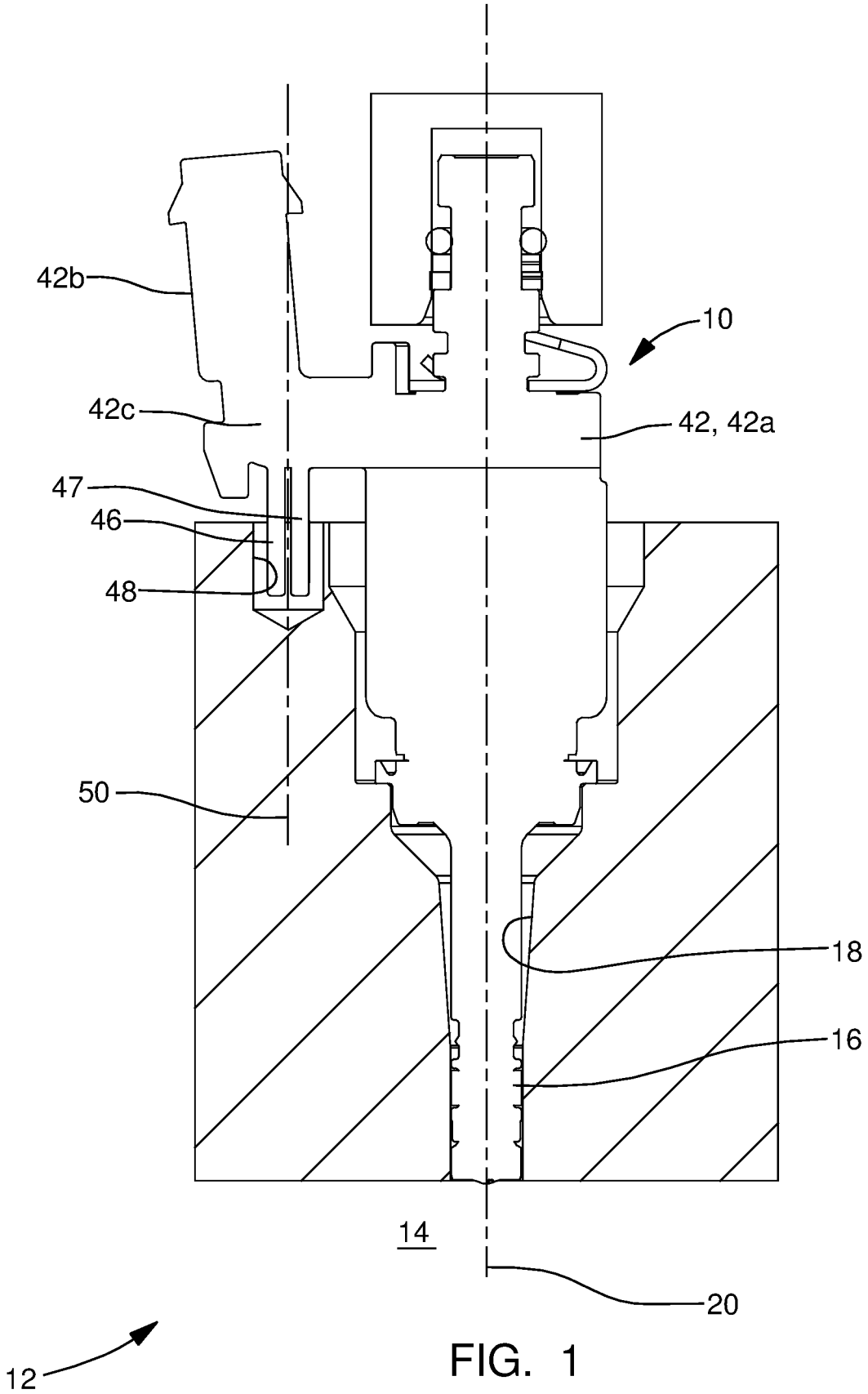
FIG. 1 is an elevation view of a fuel injector in accordance with the present invention installed in an internal combustion engine.
Figure 2:
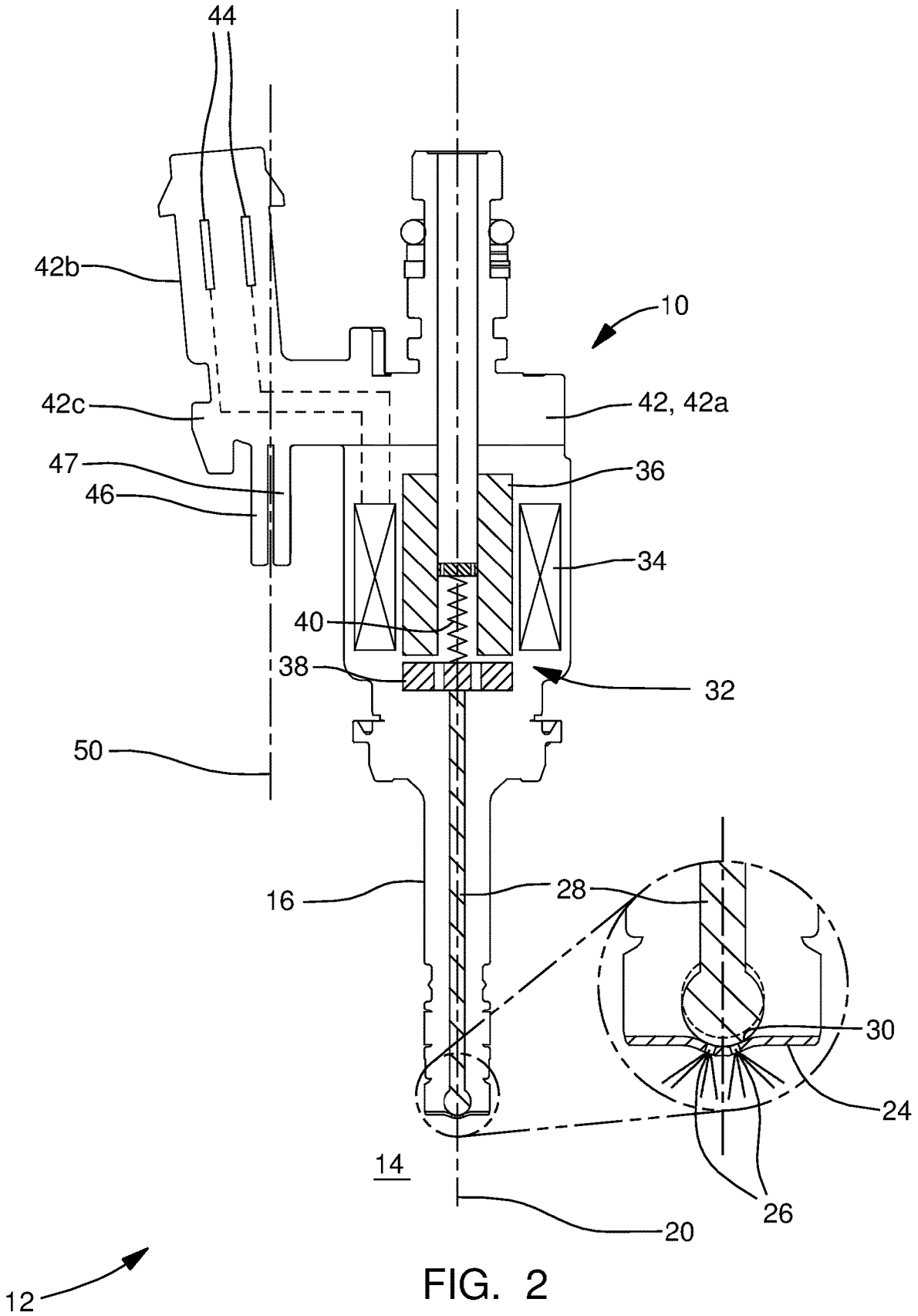
FIG. 2 is a schematic view of the fuel injector of FIG. 1.

In accordance with a preferred embodiment of this invention and referring initially to FIGS. 1 and 2, a fuel injector 10 is illustrated installed in an internal combustion engine 12 where fuel injector 10 is provided for injecting fuel into a combustion chamber 14 of internal combustion engine 12 where the fuel is combusted therein as is well known to those of ordinary skill in the art. The fuel which is injected by fuel injector 10 into combustion chamber 14 may be any one of numerous fuels commonly used by internal combustion engines, but may preferably be a liquid fuel which may be, by way of non-limiting example only, gasoline, alcohol, ethanol, diesel fuel, biodiesel, and the like or blends of one or more thereof or may alternatively be a gaseous fuel such as compressed natural gas (CNG) or propane.

Fuel injector 10 generally includes a nozzle body 16 which is configured to be inserted into a fuel injector receiving bore 18 of internal combustion engine 12 along a nozzle body axis 20 such that a nozzle tip 24 communicates with combustion chamber 14 and includes one or more nozzle openings 26 therein from which fuel is selectively discharged from fuel injector 10 into combustion chamber 14. The discharge of fuel from nozzle openings 26 is controlled by a valve needle 28 located within nozzle body 16 where valve needle 28 is selectively seated with a valve seat 30 (shown in solid lines in the enlarged portion of FIG. 2) to stop discharge of fuel through nozzle openings 26 and is selectively unseated with valve seat 30 (shown in phantom lines in the enlarged portion of FIG. 2) to discharge fuel from fuel injector 10 into combustion chamber 14. Movement of valve needle 28 is controlled by an actuator 32, illustrated herein as a solenoid actuator. As embodied herein, actuator 32 includes a wire winding 34, a pole piece 36 which is stationary, an armature 38 which is moveable with valve needle 28, and a return spring 40 which urges valve needle 28 in a direction to be seated with valve seat 30. When wire winding 34 is energized with an electric current, armature 38 is magnetically attracted to pole piece 36, thereby unseating valve needle 28 from valve seat 30. Conversely, when the electric current to wire winding 34 is stopped, the magnetic attraction between armature 38 and pole piece 36 is stopped, thereby allowing return spring 40 to move valve needle 28 to be seated with valve seat 30. While actuator 32 has been illustrated herein as a solenoid actuator, it should be understood that actuator 32 may take other forms, which may be, by way of non-limiting example only, a piezoelectric actuator. Furthermore, while actuator 32 has been illustrated as directly actuating valve needle 28, it should be understood that actuator 32 may be indirect acting such that the actuator may be used to control fuel pressure in a control chamber such that the fuel pressure in the control chamber affects the position of valve needle 28.

Fuel injector 10 also includes a valve housing 42 which is distal from nozzle tip 24. Valve housing 42 is held in fixed relationship to nozzle body 16 such that relative movement between valve housing 42 and nozzle body 16 is prevented. Valve housing 42 is made of a thermoplastic material which is preferably formed in a plastic injection molding process where liquefied plastic is injected into a mold (not shown) where the liquefied plastic is allowed to solidify before being removed from the mold. Valve housing 42 includes a valve housing first portion 42*a* which is used to fix valve housing 42 relative to nozzle body 16, a valve housing electrical connector 42*b* which includes electrical terminals 44 therein for providing electrical connection to actuator 32, and a valve housing intermediate portion 42*c* which joins valve housing first portion 42*a* to valve housing electrical connector 42*b*. Valve housing electrical connector 42*b* is configured to mate with a complementary electrical connector (not shown) which makes electrical connection with electrical terminals 44 to selectively supply electric current thereto.

In order to achieve desired combustion which produces low levels of emissions, nozzle tip 24 must be properly oriented with respect to combustion chamber 14 about nozzle body axis 20, thereby allowing fuel emitted from nozzle openings 26 to be introduced into combustion chamber 14 in such a way as to promote efficient combustion. It is important to note that the desired orientation of nozzle tip 24 with respect to combustion chamber 14 is dependent on may factors which may be, by way of non-limiting example only, the location of fuel injector receiving bore 18 relative to combustion chamber 14 and the location of a spark plug (not shown) which may be used to ignite the fuel. Furthermore, a practitioner of ordinary skill in the art would be able to determine the desired orientation of nozzle tip 24 with respect to combustion chamber 14, for example, through modeling or empirical testing. Fuel injector 10 includes a first locating pin 46 extending from valve housing 42 and a second locating pin 47 also extending from valve housing 42. First locating pin 46 and second locating pin 47 are configured to be collectively inserted into a locating bore 48 in order to ensure proper orientation of nozzle tip 24 with respect to combustion chamber 14 about nozzle body axis 20 such that first locating pin 46 and second locating pin 47 collectively prevent rotational movement of fuel injector 10 about nozzle body axis 20 through elastic deformation of first locating pin 46 and second locating pin 47. Locating bore 48 may be located in the same portion of internal combustion engine 12 within which fuel injector receiving bore 18 is located or may be located in another element which is otherwise maintained in a fixed position relative to combustion chamber 14. First locating pin 46 and second locating pin 47 will be described in greater detail in the paragraphs that follow.

Figure 3:
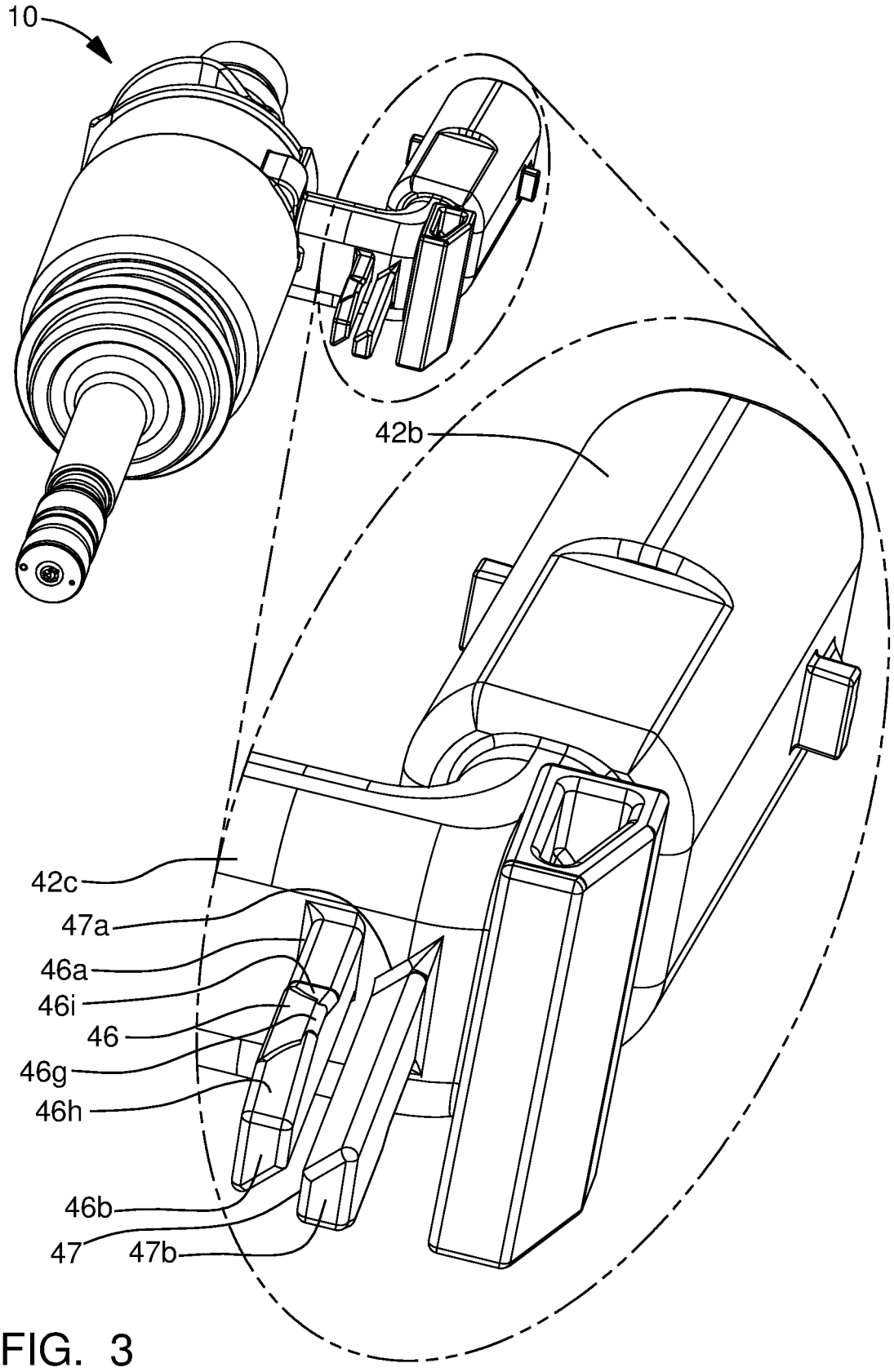
FIG. 3 is an isometric view of the fuel injector of FIG. 1.
Figure 4:
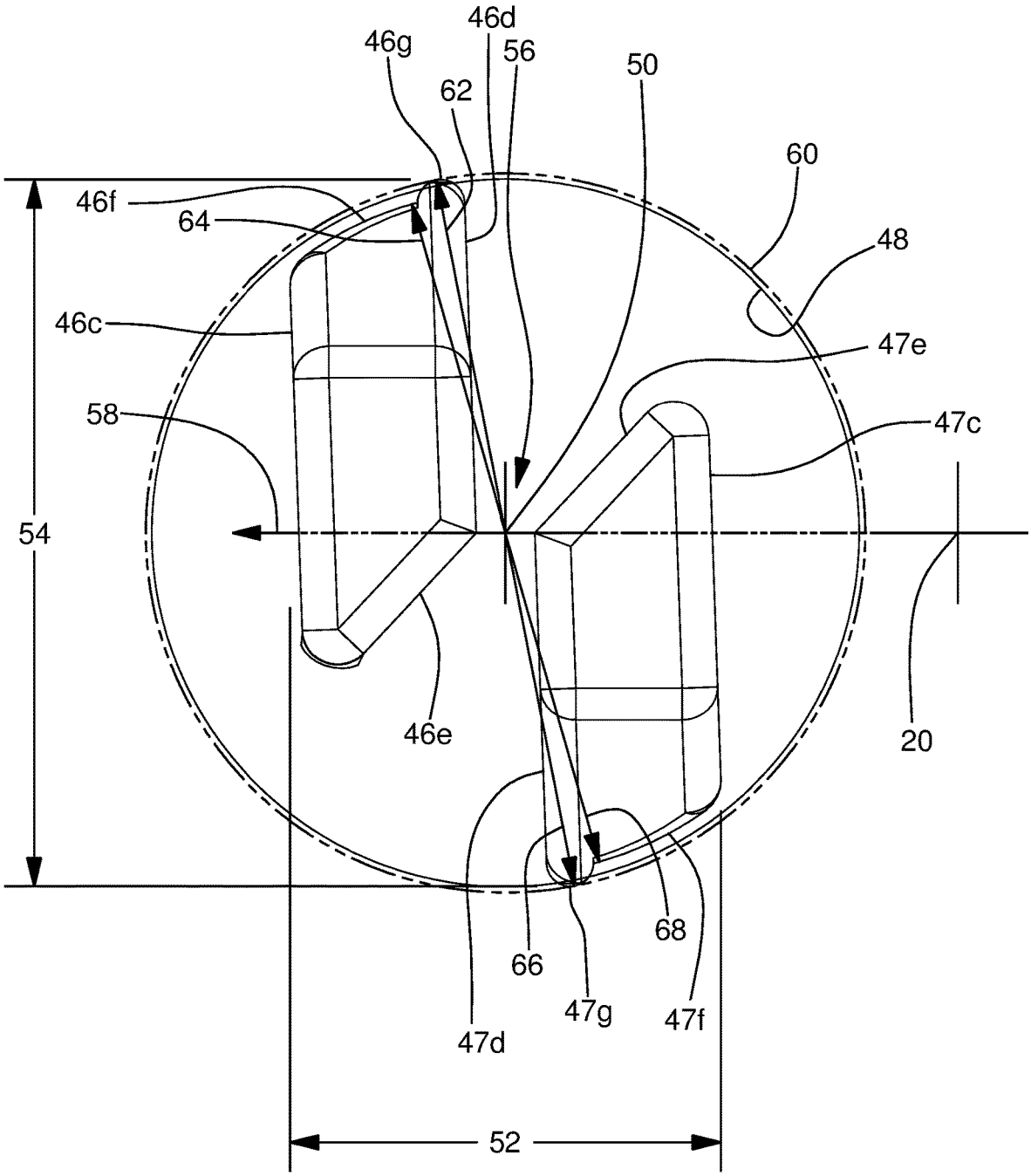
FIG. 4 is an end view of a first locating pin and a second locating pin of the fuel injector of FIG. 1.
Figure 5:
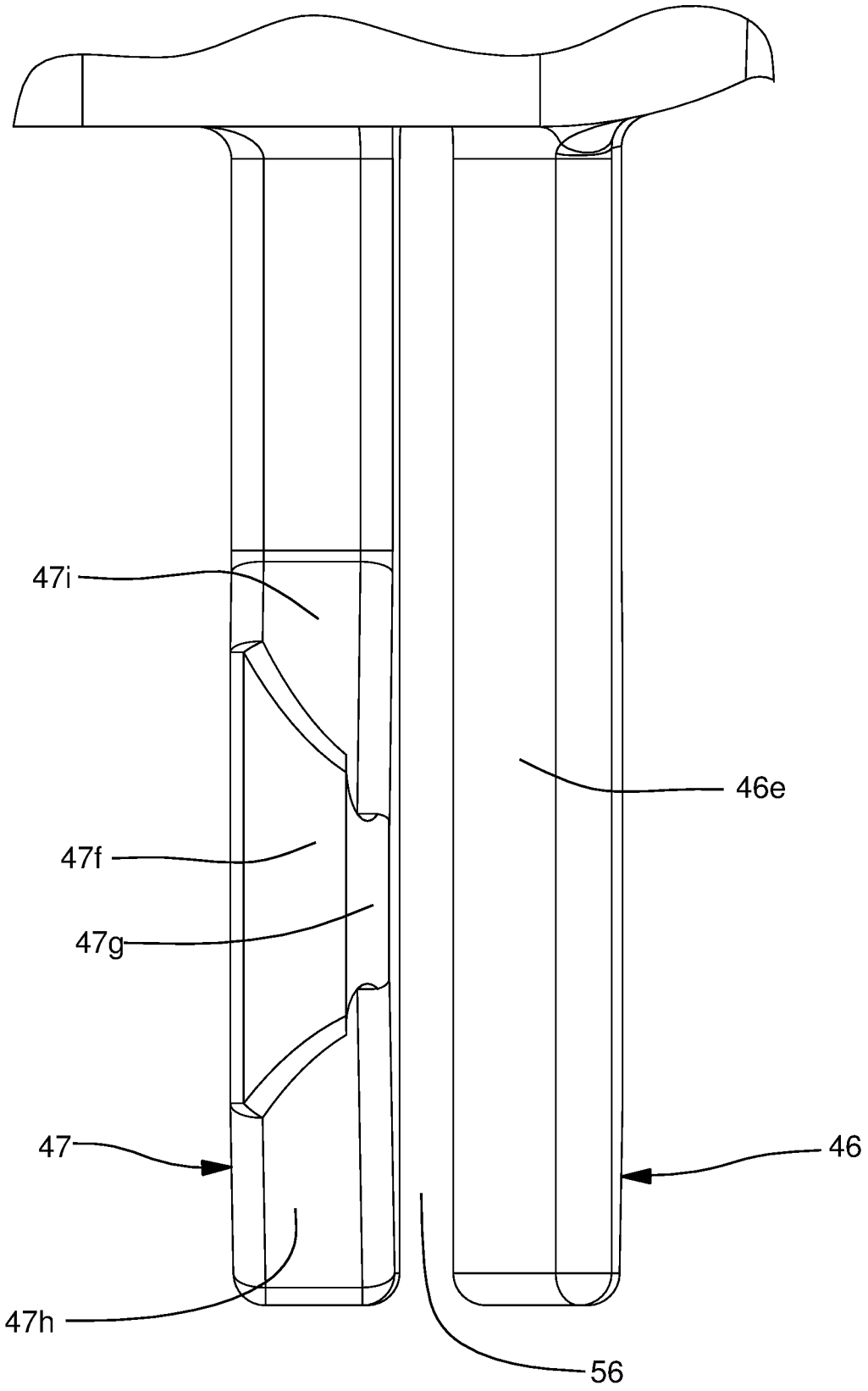
FIG. 5 is an elevation view of the first locating pin and the second locating pin of FIG. 4.

Now with addition reference to FIGS. 3-5, first locating pin 46 and second locating pin 47 each extend from valve housing 42, and more particularly valve housing intermediate portion 42*c*, such that first locating pin 46 and second locating pin 47 are collectively centered about a locating pin axis 50. First locating pin 46 extends from a first locating pin fixed end 46*a* which is fixed to valve housing 42 to a first locating pin free end 46*b* which terminates first locating pin 46, and similarly, second locating pin 47 extends from a second locating pin fixed end 47*a* which is fixed to valve housing 42 to a second locating pin free end 47*b* which terminates second locating pin 47. Locating pin axis 50 is eccentric to nozzle body axis 20 and is also preferably parallel to nozzle body axis 20. As shown in FIG. 4, first locating pin 46 and second locating pin 47 collectively have a width 52 in a first direction radially relative to nozzle body axis 20 and through locating pin axis 50. First locating pin 46 and second locating pin 47 also collectively have a length 54 in a second direction which is perpendicular to width 52 and in a plane perpendicular to locating pin axis 50 such that length 54 is greater in magnitude than width 52. A gap 56, i.e. void space, is formed between first locating pin 46 and second locating pin 47 such that gap 56 extends from first locating pin free end 46*b* and second locating pin free end 47*b* to first locating pin fixed end 46*a* and second locating pin fixed end 47*a*. As best illustrated in FIG. 4, an imaginary ray 58 extending radially from nozzle body axis 20 and through locating pin axis 50 passes through first locating pin 46, second locating pin 47, and gap 56. As should be apparent from FIG. 4, by having length 54 greater in magnitude than width 52, orientation of nozzle tip 24 is determined collectively by first locating pin 46 and second locating pin 47 at length 54 and rotation about nozzle body axis 20 is prevented collectively by first locating pin 46 and second locating pin 47.

First locating pin 46 includes a first locating pin first surface 46*c* which is planar and a first locating pin second surface 46*d* which is planar and parallel to first locating pin first surface 46*c* such that imaginary ray 58 passes through first locating pin first surface 46*c* and first locating pin second surface 46*d*. A first locating pin third surface 46*e* is planar and extends between first locating pin first surface 46*c* and first locating pin second surface 46*d* where first locating pin third surface 46*e* joins first locating pin first surface 46*c* and first locating pin second surface 46*d* with, for example, one or more radii, as shown. Opposing first locating pin third surface 46*e* is a first locating pin fourth surface 46*f* which is curvilinear and extends between first locating pin first surface 46*c* and first locating pin second surface 46*d*. First locating pin fourth surface 46*f* includes a first locating pin contact pad 46*g* projecting outward therefrom at length 54 which is configured to engage locating bore 48 in order to elastically deform first locating pin 46 when first locating pin 46 is inserted into locating bore 48. A first locating pin fifth surface 46*h* extends between first locating pin first surface 46*c* and first locating pin second surface 46*d* and also between first locating pin free end 46*b* and first locating pin fourth surface 46*f* such that first locating pin fifth surface 46*h* is planar and is tapered outward such that first locating pin fifth surface 46*h* causes the cross sectional area of first locating pin 46, i.e. perpendicular to locating pin axis 50, to increase in a direction from first locating pin free end 46*b* to first locating pin fourth surface 46*f*. A first locating pin sixth surface 46*i* extends between first locating pin first surface 46*c* and first locating pin second surface 46*d* and also from first locating pin fourth surface 46*f* toward first locating pin fixed end 46*a* such that first locating pin sixth surface 46*i* is planar and is tapered inward such that first locating pin sixth surface 46*i* causes the cross sectional area of first locating pin 46, i.e. perpendicular to locating pin axis 50, to decrease in a direction from first locating pin fourth surface 46*f* toward first locating pin fixed end 46*a*. The tapered nature of first locating pin fifth surface 46*h* and first locating pin sixth surface 46*i* allows for easy insertion of first locating pin 46 into locating bore 48.

Second locating pin 47 includes a second locating pin first surface 47*c* which is planar and a second locating pin second surface 47*d* which is planar and parallel to second locating pin first surface 47*c* such that imaginary ray 58 extends through second locating pin first surface 47*c* and second locating pin second surface 47*d*. A second locating pin third surface 47*e* is planar and extends between second locating pin first surface 47*c* and second locating pin second surface 47*d* where second locating pin third surface 47*e* joins second locating pin first surface 47*c* and second locating pin second surface 47*d* with, for example, one or more radii, as shown. Opposing second locating pin third surface 47*e* is a second locating pin fourth surface 47*f* which is curvilinear and extends between second locating pin first surface 47*c* and second locating pin second surface 47*d*. Second locating pin fourth surface 47*f* includes a second locating pin contact pad 47*g* projecting outward therefrom at length 54 which is configured to engage locating bore 48 in order to elastically deform second locating pin 47 when second locating pin 47 is inserted into locating bore 48 and which is diametrically opposed to first locating pin contact pad 46*g*. As used herein, "diametrically opposed" includes being exactly diametrically opposed, i.e. spaced 180° apart about locating pin axis 50, and also includes deviations from being exactly diametrically opposed of up to 10° about locating pin axis 50. A second locating pin fifth surface 47*h* extends between second locating pin first surface 47*c* and second locating pin second surface 47*d* and also between second locating pin free end 47*b* and second locating pin fourth surface 47*f* such that second locating pin fifth surface 47*h* is planar and is tapered outward such that second locating pin fifth surface 47*h* causes the cross sectional area of second locating pin 47, i.e. perpendicular to locating pin axis 50, to increase in a direction from second locating pin free end 47*b* to second locating pin fourth surface 47*f*. A second locating pin sixth surface 47*i* extends between second locating pin first surface 47*c* and second locating pin second surface 47*d* and also from second locating pin fourth surface 47*f* toward second locating pin fixed end 47*a* such that second locating pin sixth surface 47*i* is planar and is tapered inward such that second locating pin sixth surface 47*i* causes the cross sectional area of second locating pin 47, i.e. perpendicular to locating pin axis 50, to decrease in a direction from second locating pin fourth surface 47*f* toward second locating pin fixed end 47*a*. The tapered nature of second locating pin fifth surface 47*h* and second locating pin sixth surface 47*i* allows for easy insertion of second locating pin 47 into locating bore 48.

First locating pin contact pad 46*g* and second locating pin contact pad 47*g* each extend around the periphery of a circumcircle 60 which circumscribes first locating pin contact pad 46*g* and second locating pin contact pad 47*g* for no more than 10° about locating pin axis 50. Furthermore, a first distance 62 radially outward from a point on locating pin axis 50 to first locating pin contact pad 46*g* is no more than 10% greater than a second distance 64 radially outward from the point on locating pin axis 50 to first locating pin fourth surface 46*f*. Similarly, a third distance 66 radially outward from a point on locating pin axis 50 to second locating pin contact pad 47*g* is no more than 10% greater than a fourth distance 68 radially outward from the point on locating pin axis 50 to second locating pin fourth surface 47*f*.

In order to assemble fuel injector 10 to internal combustion engine 12, nozzle body 16 is first aligned with, and inserted at least part way into, fuel injector receiving bore 18. Next, first locating pin 46 and second locating pin 47 are aligned with locating bore 48 and first locating pin 46 and second locating pin 47 are inserted into locating bore 48 such that inserting first locating pin 46 causes first locating pin contact pad 46*g* and second locating pin contact pad 47*g* to engage the inner periphery of locating bore 48 and such that first locating pin 46 and second locating pin 47 elastically deform, thereby preventing rotation of fuel injector 10 about nozzle body axis 20. The step of inserting first locating pin 46 and second locating pin 47 into locating bore 48 may also include inserting nozzle body 16 further into locating bore 48. Since first locating pin 46 and second locating pin 47 are provide with gap 56 therebetween, first locating pin 46 and second locating 47 are able to be elastically deformed independent of each other.

Figure 6:
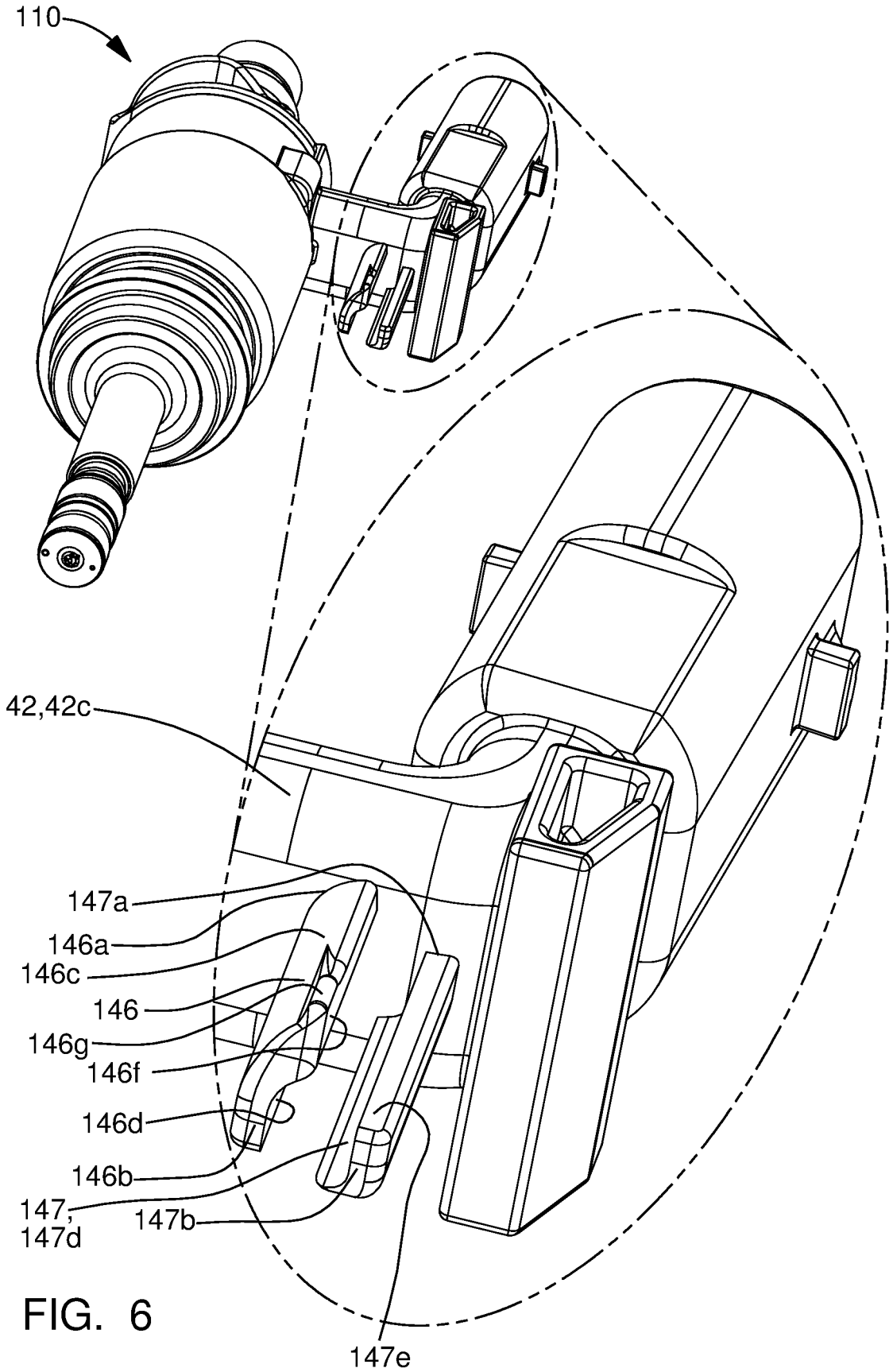
FIG. 6 is an isometric view of another fuel injector in accordance with the present invention.
Figure 7:
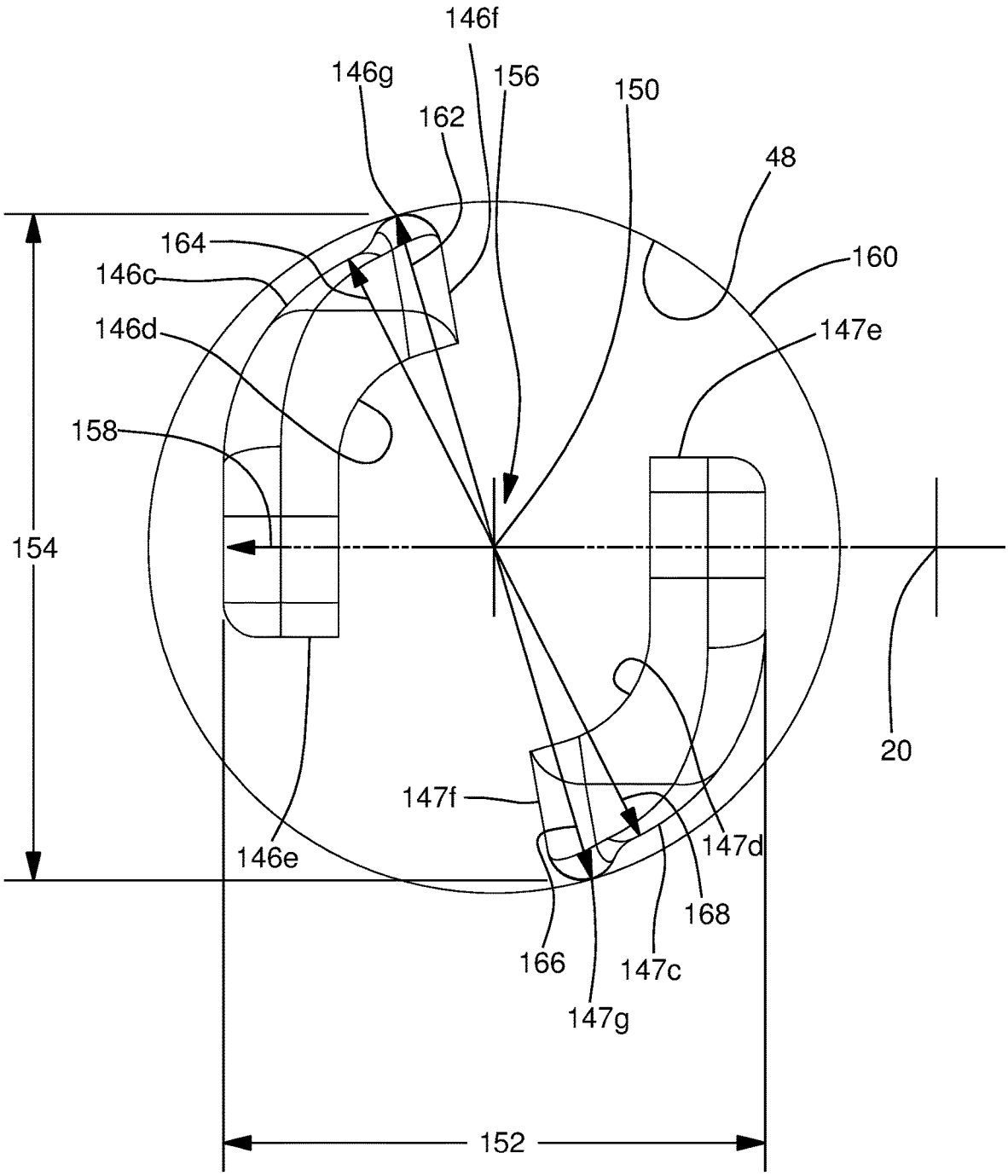
FIG. 7 is an end view of a first locating pin and a second locating pin of the fuel injector of FIG. 6.
Figure 8:
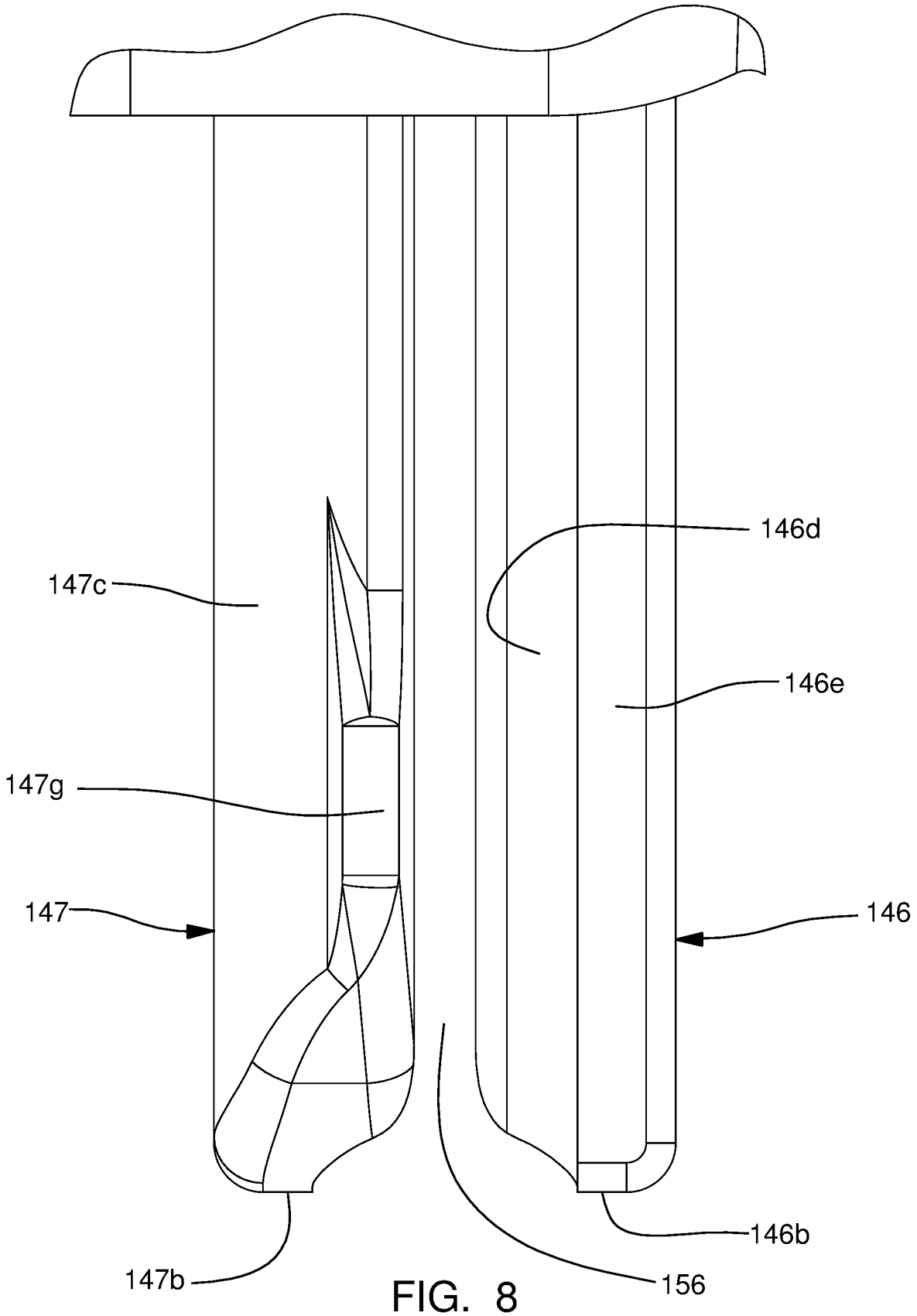
FIG. 8 is an elevation view of the first locating pin and the second locating pin of FIG. 7.

In an alternative arrangement as shown in FIGS. 6-8, a fuel injector 110 is shown which is substantially the same as fuel injector 10 except that first locating pin 46 and second locating pin 47 have been substituted with a first locating pin 146 and a second locating pin 147. Elements that are the same as fuel injector 10 will use the same reference number in the description of fuel injector 110 and only the differences of first locating pin 146 and second locating pin 147 pin will be described with the understanding that other features of fuel injector 110 fall under the same description previously provide with respect to fuel injector 10.

First locating pin 146 and second locating pin 147 each extend from valve housing 42. First locating pin 146 and second locating pin 147 are configured to be collectively inserted into locating bore 48 in order to ensure proper orientation of nozzle tip 24 with respect to combustion chamber 14 about nozzle body axis 20 such that first locating pin 146 and second locating pin 147 collectively prevent rotational movement of fuel injector 10 about nozzle body axis 20 through elastic deformation of first locating pin 146 and second locating pin 147. First locating pin 146 and second locating pin 147 will be described in greater detail in the paragraphs that follow.

First locating pin 146 and second locating pin 147 each extend from valve housing 42, and more particularly valve housing intermediate portion 42*c*, such that first locating pin 146 and second locating pin 147 are collectively centered about locating pin axis 150. First locating pin 146 extends from a first locating pin fixed end 146*a* which is fixed to valve housing 42 to a first locating pin free end 146*b* which terminates first locating pin 146, and similarly, second locating pin 147 extends from a second locating pin fixed end 147*a* which is fixed to valve housing 42 to a second locating pin free end 147*b* which terminates second locating pin 147. As shown in FIG. 7, first locating pin 146 and second locating pin 147 collectively have a width 152 in a first direction radially relative to nozzle body axis 20 and through locating pin axis 150. First locating pin 146 and second locating pin 147 also collectively have a length 154 in a second direction which is perpendicular to width 152 and in a plane perpendicular to locating pin axis 150 such that length 154 is greater in magnitude than width 152. A gap 156, i.e. void space, is formed between first locating pin 146 and second locating pin 147 such that gap 156 extends from first locating pin free end 146*b* and second locating pin free end 147*b* to first locating pin fixed end 146*a* and second locating pin fixed end 147*a*. As best illustrated in FIG. 7, an imaginary ray 158 extending radially from nozzle body axis 20 and through locating pin axis 150 passes through first locating pin 146, second locating pin 147, and gap 156. As should be apparent from FIG. 7, by having length 154 greater in magnitude than width 152, orientation of nozzle tip 24 is determined collectively by first locating pin 146 and second locating pin 147 at length 154 and rotation about nozzle body axis 20 is collectively prevented by first locating pin 146 and second locating pin 147.

First locating pin 146 includes a first locating pin first surface 146*c* which is curvilinear and convex facing away from locating pin axis 150 and also includes a first locating pin second surface 146*d* which is curvilinear and concave facing toward locating pin axis 150. A first locating pin third surface 146*e* is planar and extends between first locating pin first surface 146*c* and first locating pin second surface 146*d* where first locating pin third surface 146*e* joins first locating pin first surface 146*c* and first locating pin second surface 146*d* with, for example, one or more radii, as shown. A first locating pin fourth surface 146*f* is planar and extends between first locating pin first surface 146*c* and first locating pin second surface 146*d*. First locating pin first surface 146*c* includes a first locating pin contact pad 146*g* projecting outward therefrom at length 154 which is configured to engage locating bore 48 in order to elastically deform first locating pin 146 when first locating pin 146 is inserted into locating bore 48. As shown in the figures, first locating pin 146 is tapered from first locating pin contact pad 146*g* toward first locating pin free end 146*b*, thereby causing the cross-sectional area of first locating pin 146 to decrease from first locating pin contact pad 146*g* toward first locating pin free end 146*b* and also thereby allowing for easy insertion of first locating pin 146 into locating bore 48.

Second locating pin 147 includes a second locating pin first surface 147*c* which is curvilinear and convex facing away from locating pin axis 150 and also includes a second locating pin second surface 147*d* which is curvilinear and concave facing toward locating pin axis 150. A second locating pin third surface 147*e* is planar and extends between second locating pin first surface 147*c* and second locating pin second surface 147*d* where second locating pin third surface 147*e* joins second locating pin first surface 147*c* and second locating pin second surface 147*d* with, for example, one or more radii, as shown. A second locating pin fourth surface 147*f* is planar and extends between second locating pin first surface 147*c* and second locating pin second surface 147*d*. Second locating pin first surface 147*c* includes a second locating pin contact pad 147*g* projecting outward therefrom at length 154 which is configured to engage locating bore 48 in order to elastically deform second locating pin 147 when second locating pin 147 is inserted into locating bore 48 and which is diametrically opposed to first locating pin contact pad 146*g*. As used herein, "diametrically opposed" includes being exactly diametrically opposed, i.e. spaced 180° apart about locating pin axis 150, and also includes deviations from being exactly diametrically opposed of up to 10° about locating pin axis 150. As shown in the figures, second locating pin 147 is tapered from second locating pin contact pad 147*g* toward second locating pin free end 147*b*, thereby causing the cross-sectional area of second locating pin 147 to decrease from second locating pin contact pad 147*g* toward second locating pin free end 147*b* and also thereby allowing for easy insertion of second locating pin 147 into locating bore 48.

First locating pin contact pad 146*g* and second locating pin contact pad 147*g* each extend around the periphery of a circumcircle 160 (shown as coincident with locating bore 48 in FIG. 7) which circumscribes first locating pin contact pad 146*g* and second locating pin contact pad 147*g* for no more than 10° about locating pin axis 150. Furthermore, a first distance 162 radially outward from a point on locating pin axis 150 to first locating pin contact pad 146*g* is no more than 10% greater than a second distance 164 radially outward from the point on locating pin axis 150 to first locating pin first surface 146*c*. Similarly, a third distance 166 radially outward from a point on locating pin axis 150 to second locating pin contact pad 147*g* is no more than 10% greater than a fourth distance 168 radially outward from the point on locating pin axis 150 to second locating pin first surface 147*c*.

In order to assemble fuel injector 110 to internal combustion engine 12, nozzle body 16 is first aligned with, and inserted at least part way into, fuel injector receiving bore 18. Next, first locating pin 146 and second locating pin 147 are aligned with locating bore 48 and first locating pin 146 and second locating pin 147 are inserted into locating bore 48 such that inserting first locating pin 146 and second locating pin 147 causes first locating pin contact pad 146*g* and second locating pin contact pad 147*g* to engage the inner periphery of locating bore 48 and such that first locating pin 146 and second locating pin 147 elastically deform, thereby preventing rotation of fuel injector 10 about nozzle body axis 20. Due to first locating pin first surface 146*c* and first locating pin second surface 146*d* being curvilinear, elastic deformation of first locating pin 146 includes twisting in a plane that is perpendicular to locating pin axis 150. Similarly, due to second locating pin first surface 147*c* and second locating pin second surface 147*d* being curvilinear, elastic deformation of first locating pin 146 includes twisting in a plane that is perpendicular to locating pin axis 150. The step of inserting first locating pin 146 and second locating pin 147 into locating bore 48 may also include inserting nozzle body 16 further into locating bore 48. Since first locating pin 146 and second locating pin 147 are provide with gap 156 therebetween, first locating pin 146 and second locating 147 are able to be elastically deformed independent of each other.

It should be noted that FIG. 4 illustrates first locating pin 46 and second locating pin 47 in a free state, i.e. not elastically deformed, in order to illustrate the interference that first locating pin 46 and second locating pin 47 encounter with locating bore 48. Conversely, FIG. 7 illustrates first locating pin 146 and second locating pin 147 in an elastically deformed state in order to illustrate how first locating pin 146 and second locating pin 147 elastically deform to conform to locating bore 48. However, it should now be understood that first locating pin 46 and second locating pin 47 elastically deform similar to the illustration of first locating pin 146 and second locating pin 147 when inserted into locating bore 48.

While this invention has been described in terms of preferred embodiments thereof, it is not intended to be so limited, but rather only to the extent set forth in the claims that follow.

We claim:

1. A fuel injector for injecting fuel into a combustion chamber of an internal combustion engine, said fuel injector comprising:

a nozzle body configured to be inserted into a fuel injector receiving bore of said internal combustion engine along a nozzle body axis;

a valve housing held in fixed relationship to said nozzle body; and a first locating pin and a second locating pin each extending from said valve housing, said first locating pin extending from a first locating pin fixed end which is fixed to said valve housing to a first locating pin free end and said second locating pin extending from a second locating pin fixed end which is fixed to said valve housing to a second locating pin free end, said first locating pin and said second locating pin collectively being configured to be inserted into a locating bore which elastically deforms said first locating pin and said second locating pin, thereby preventing rotational movement of said fuel injector about said nozzle body axis said first locating pin and said second locating pin are collectively centered about a locating pin axis which is eccentric to said nozzle body axis a gap is formed between said first locating pin and said second locating pin such that said gap extends from said first locating pin free end and said second locating pin free end to said first locating pin fixed end and to said second locating pin fixed end and such that said locating pin axis is located within said gap.

2. A fuel injector as in claim 1, wherein said locating pin axis is parallel to said nozzle body axis.

3. A fuel injector as in claim 1, wherein an imaginary ray extending radially from said nozzle body axis and through said locating pin axis passes through said first locating pin and said second locating pin.

4. A fuel injector as in claim 1, wherein said first locating pin and said second locating pin collectively have 1) a width in a first direction radially relative to said nozzle body axis and through said locating pin axis and 2) a length in a second direction which is perpendicular to said width such that said width is less than said length.

5. A fuel injector as in claim 4, wherein:

said first locating pin includes a first locating pin contact pad at a first end of said length; and said second locating pin includes a second locating pin contact pad at a second end of said length which is opposite from said first end of said length, said second locating pin contact pad being diametrically located from said first locating pin contact pad about said locating pin axis.

6. An internal combustion engine comprising:

a combustion chamber;

a fuel injector receiving bore;

a locating bore; and a fuel injector comprising:

a nozzle body within said fuel injector receiving bore along a nozzle body axis;

a valve housing held in fixed relationship to said nozzle body; and a first locating pin and a second locating pin each extending from said valve housing, said first locating pin extending from a first locating pin fixed end which is fixed to said valve housing to a first locating pin free end and said second locating pin extending from a second locating pin fixed end which is fixed to said valve housing to a second locating pin free end, said first locating pin and said second locating being elastically deformed within said locating bore, thereby preventing rotational movement of said fuel injector about said nozzle body axis said first locating pin and said second locating pin are collectively centered about a locating pin axis which is eccentric to said nozzle body axis a gap is formed between said first locating pin and said second locating pin such that said gap extends from said first locating pin free end and said second locating pin free end to said first locating pin fixed end and to said second locating pin fixed end and such that said locating pin axis is located within said gap.

7. An internal combustion engine as in claim 6, wherein said locating pin axis is parallel to said nozzle body axis.

8. An internal combustion engine as in claim 6, wherein an imaginary ray extending radially from said nozzle body axis and through said locating pin axis passes through said first locating pin and said second locating pin.

9. An internal combustion engine as in claim 6, wherein said first locating pin and said second locating pin collectively have 1) a width in a first direction radially relative to said nozzle body axis and through said locating pin axis and 2) a length in a second direction which is perpendicular to said width such that said width is less than said length.

10. An internal combustion engine as in claim 9, wherein:

said first locating pin includes a first locating pin contact pad at a first end of said length; and said second locating pin includes a second locating pin contact pad at a second end of said length which is opposite from said first end of said length, said second locating pin contact pad being diametrically located from said first locating pin contact pad about said locating pin axis.

11. A method of assembling a fuel injector to an internal combustion engine where the internal combustion engine includes a fuel injector receiving bore and a locating bore and where the fuel injector includes a nozzle body extending along a nozzle body axis; a valve housing held in fixed relationship to said nozzle body; and a first locating pin and a second locating pin each extending from said valve housing, said first locating pin extending from a first locating pin fixed end which is fixed to said valve housing to a first locating pin free end and said second locating pin extending from a second locating pin fixed end which is fixed to said valve housing to a second locating pin free end, said method comprising:

inserting said nozzle body into said fuel injector receiving bore;

inserting said first locating pin and said second locating pin into said locating bore; and elastically deforming said first locating pin and said second locating pin while said first locating pin and said second locating pin are being inserted into said locating bore such that said first locating pin and said second locating pin radially orient said nozzle body in said fuel injector receiving bore and thereby preventing rotation movement of said fuel injector about said nozzle body axis said first locating pin and said second locating pin are collectively centered about a locating pin axis which is eccentric to said nozzle body axis a gap is formed between said first locating pin and said second locating pin such that said gap extends form said first locating pin free end and said second locating pin free end to said first locating pin fixed end and to said second locating pin fixed end and such that said locating pin axis is located within said gap.

* * * * *